US012768588B2

(12) United States Patent
Vijayan et al.

(10) Patent No.: US 12,768,588 B2
(45) Date of Patent: Oct. 20, 2026

(54) METHOD OF OPERATING A COMPRESSOR OF A REFRIGERATOR APPLIANCE

(71) Applicant: Haier US Appliance Solutions, Inc., Wilmington, DE (US)

(72) Inventors: Vineeth Vijayan, Louisville, KY (US); Michael Goodman Schroeder, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 39 days.

(21) Appl. No.: 18/806,245

(22) Filed: Aug. 15, 2024

(65) Prior Publication Data

US 2026/0049760 A1 Feb. 19, 2026

(51) Int. Cl.
*F25D 29/00* (2006.01)
*F25D 11/02* (2006.01)

(52) U.S. Cl.
CPC ..... *F25D 29/005* (2013.01); *F25D 11/022* (2013.01)

(58) Field of Classification Search
CPC ..... F25D 29/005; F25D 11/022
See application file for complete search history.

(56) References Cited

U.S. PATENT DOCUMENTS

| | | | | |
|---|---|---|---|---|
| 10,641,533 | B2 | 5/2020 | Cho et al. | |
| 2017/0370635 | A1* | 12/2017 | Cho | F25D 29/00 |
| 2020/0116418 | A1* | 4/2020 | Brooke | F25D 17/045 |

FOREIGN PATENT DOCUMENTS

| | | | | |
|---|---|---|---|---|
| CN | 2497254 | Y * | 6/2002 | |
| CN | 104792077 | B | 10/2020 | |
| EP | 2733257 | B1 | 10/2021 | |
| JP | H0772661 | B2 * | 8/1995 | |
| JP | 2002364937 | A * | 12/2002 | |
| JP | 2004116841 | A * | 4/2004 | |
| TW | I391619 | B * | 4/2013 | F25B 1/00 |
| WO | WO2009150824 | A1 | 12/2009 | |
| WO | WO-2015189009 | A1 * | 12/2015 | F25D 29/00 |

* cited by examiner

*Primary Examiner* — Kun Kai Ma
(74) *Attorney, Agent, or Firm* — Dority & Manning, P.A.

(57) ABSTRACT

A refrigerator appliance includes a cabinet defining one or more chilled chambers, a sealed system comprising a compressor and one or more evaporators thermally coupled to the one or more chilled chambers, and a controller operably coupled to the compressor. The controller is configured to identify a change of state of the sealed system, determine a compressor operation profile, the compressor operation profile being variable as a function of time, and operate the compressor in accordance with the compressor operation profile.

18 Claims, 5 Drawing Sheets

METHOD OF OPERATING A COMPRESSOR OF A REFRIGERATOR APPLIANCE

FIELD OF THE INVENTION

The present subject matter relates generally to refrigerator appliances, and more particularly to methods for operating a compressor within a refrigerator appliance.

BACKGROUND OF THE INVENTION

Refrigerator appliances generally include a cabinet that defines one or more chilled chambers for receipt of food articles for storage. Typically, one or more doors are rotatably hinged to the cabinet to permit selective access to food items stored in the chilled chamber. Further, refrigerator appliances commonly include ice making assemblies mounted within an icebox on one of the doors or in a freezer compartment. The ice is stored in a storage bin and is accessible from within the freezer chamber or may be discharged through a dispenser recess defined on a front of the refrigerator door.

Conventional refrigerator appliances include a sealed system that includes a compressor for circulating refrigerant to facilitate a cooling process within the refrigerator compartments. However, during transitional phases of compressor operation, the operating efficiency of compressor and sealed system is relatively low. For example, when a refrigerant regulating valve is switched (e.g., to pass refrigerant through one or more evaporators) or when the compressor is starting up or changing speed, the compressor may be using a lot a power but that power is used to build new pressure and temperature gradients, not as much toward cooling through the sealed system.

Accordingly, a refrigerator appliance and improved methods for operating the compressor would be desirable. More particularly, a method for operating a compressor with improved efficiency and desired sealed system performance would be particularly beneficial.

BRIEF DESCRIPTION OF THE INVENTION

Aspects and advantages of the invention will be set forth in part in the following description, may be apparent from the description, or may be learned through practice of the invention.

In one exemplary embodiment, a refrigerator appliance defining a vertical direction, a lateral direction, and a transverse direction is provided, including a cabinet defining one or more chilled chambers, a sealed system comprising a compressor and one or more evaporators thermally coupled to the one or more chilled chambers, and a controller operably coupled to the compressor. The controller is configured to identify a change of state of the sealed system, determine a compressor operation profile, the compressor operation profile being variable as a function of time, and operate the compressor in accordance with the compressor operation profile.

In another exemplary embodiment, a method of operating a compressor of a refrigerator appliance is provided. The refrigerator appliance includes one or more chilled chambers and a sealed system comprising a compressor and one or more evaporators thermally coupled to the one or more chilled chambers. The method includes identifying a change of state of the sealed system, determining a compressor operation profile, the compressor operation profile being variable as a function of time, and operating the compressor in accordance with the compressor operation profile.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
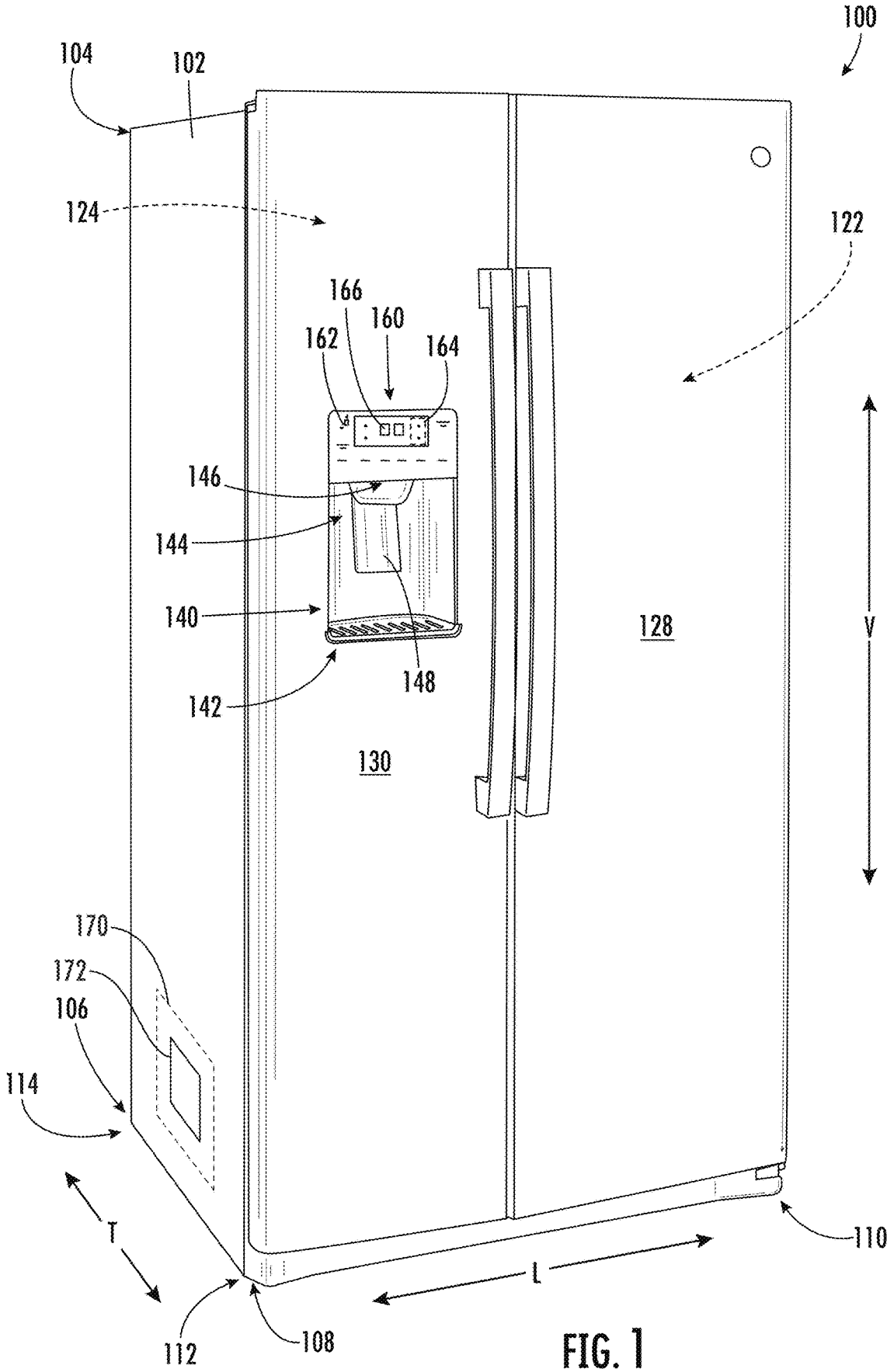
FIG. 1 provides a perspective view of a refrigerator appliance according to an example embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). The term "at least one of" in the context of, e.g., "at least one of A, B, and C" refers to only A, only B, only C, or any combination of A, B, and C. In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As explained herein, aspects of the present subject matter are generally directed to a refrigerator compressor that utilizes an open loop compressor speed profile in order to increase efficiency during transitional phases of a cycle (compressor turns ON or valve changes). A control scheme may merge the two categories of static (constant speed) and dynamic (variable speed) compressor, and produce a variable compressor speed as a function of time, without using a temperature target to calculate speed like a PID-type controller. When the sealed system state changes (compressor turns ON or valve changes), the time may be set to zero for the time-based speed function. As time increases, the function may progress and check its set speed against established min/max values, which allows the cycle to avoid drifting into less efficient compressor speeds, or speeds that are detrimental to compressor reliability. In addition, some example profiles include multipart linear, exponential, logarithmic, step functions, polynomials, etc., each of which may be tuned to work with the sealed system itself, and are highly dependent on component selection. The parameters of the profile may be updated digitally (based on lab test data) after the product is in the field. The parameters may be different for different ambient temperatures, fresh food chamber/freezer set points, etc. Also, the parameters may be unique for fresh food cooling versus freezer cooling versus dual cooling modes, and for a grid-type of control system may only be applied for some parts of the grid.

FIG. 1 provides a perspective view of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 122 positioned at or adjacent second side 110 of housing 102 and a freezer chamber 124 arranged at or adjacent first side 108 of housing 102. As such, refrigerator appliance 100 is generally referred to as a side-by-side refrigerator. It is recognized, however, that the benefits of the present disclosure apply to other types and styles of refrigerator appliances such as, e.g., a top mount refrigerator appliance, a bottom mount refrigerator appliance, or a single door refrigerator appliance. Consequently, the description set forth herein is for illustrative purposes only and is not intended to be limiting in any aspect to any particular refrigerator chamber configuration.

A refrigerator door 128 is rotatably hinged to an edge of housing 102 for selectively accessing fresh food chamber 122. In addition, a freezer door 130 is rotatably hinged to an edge of housing 102 for selectively accessing freezer chamber 124. Refrigerator door 128 and freezer door 130 are shown in the closed configuration in FIG. 1. One skilled in the art will appreciate that other chamber and door configurations are possible and within the scope of the present invention.

Figure 2:
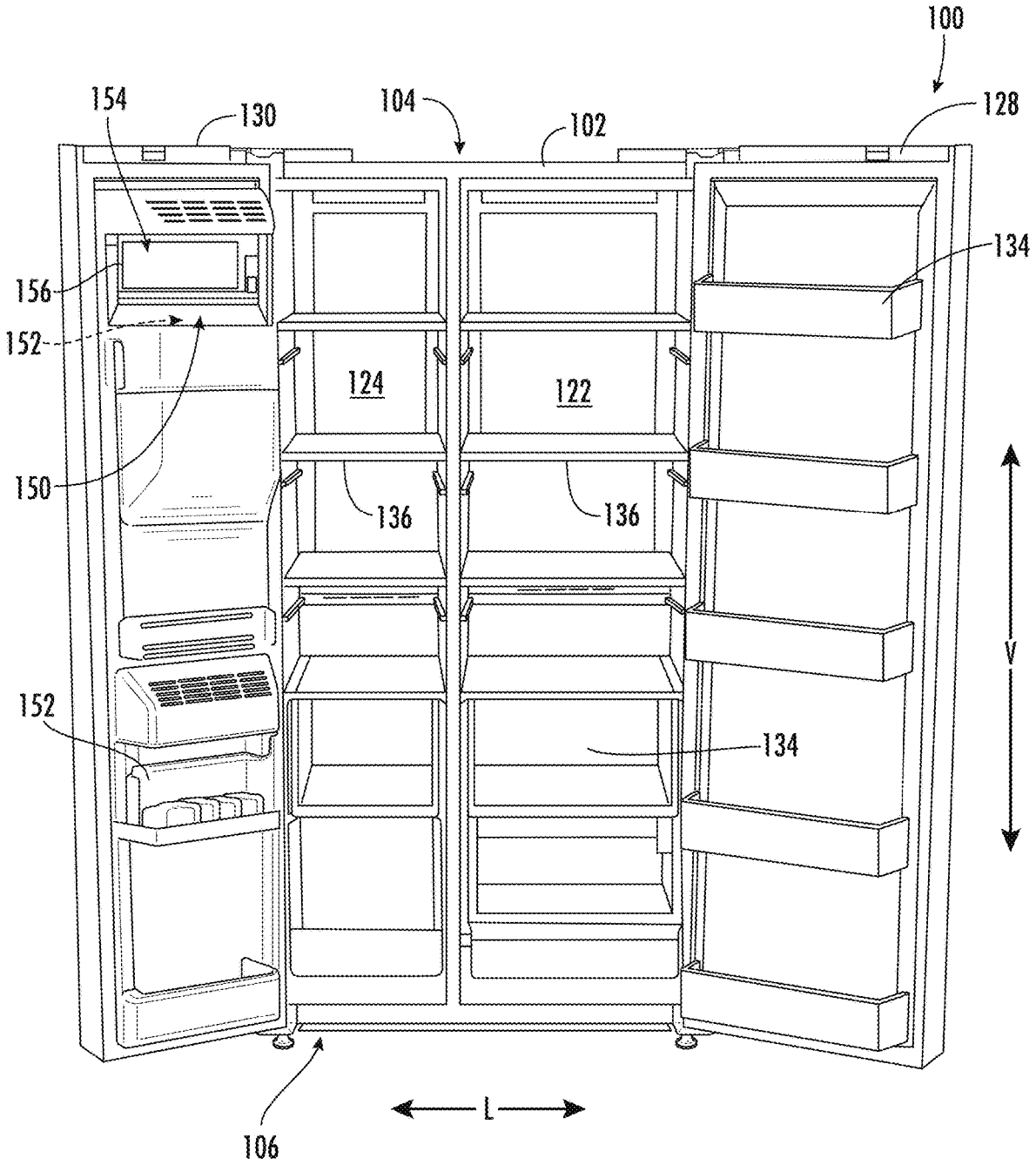
FIG. 2 provides a front view of the example refrigerator appliance of FIG. 1, with the doors of the fresh food chamber and freezer chamber shown in an open position.

FIG. 2 provides a front view of refrigerator appliance 100 shown with refrigerator door 128 and freezer door 130 in the open position. As shown in FIG. 2, various storage components are mounted within fresh food chamber 122 to facilitate storage of food items therein as will be understood by those skilled in the art. In particular, the storage components may include bins 134 and shelves 136. Each of these storage components are configured for receipt of food items (e.g., beverages and/or solid food items) and may assist with organizing such food items. As illustrated, bins 134 may be mounted on refrigerator door 128 and freezer door 130 or may slide into a receiving space in fresh food chamber 122 or freezer chamber 124. It should be appreciated that the illustrated storage components are used only for the purpose of explanation and that other storage components may be used and may have different sizes, shapes, and configurations.

Referring now generally to FIG. 1, a dispensing assembly 140 will be described according to exemplary embodiments of the present subject matter. Dispensing assembly 140 is generally configured for dispensing liquid water and/or ice. Although an exemplary dispensing assembly 140 is illustrated and described herein, it should be appreciated that variations and modifications may be made to dispensing assembly 140 while remaining within the present subject matter.

Dispensing assembly 140 and its various components may be positioned at least in part within a dispenser recess 142 defined on freezer door 130. In this regard, dispenser recess 142 is defined on a front side 112 of refrigerator appliance 100 such that a user may operate dispensing assembly 140 without opening freezer door 130. In addition, dispenser recess 142 is positioned at a predetermined elevation convenient for a user to access ice and enabling the user to access ice without the need to bend-over. In the exemplary embodiment, dispenser recess 142 is positioned at a level that approximates the chest level of a user.

Dispensing assembly 140 includes an ice dispenser 144 including a discharging outlet 146 for discharging ice from dispensing assembly 140. An actuating mechanism 148, shown as a paddle, is mounted below discharging outlet 146 for operating ice or water dispenser 144. In alternative exemplary embodiments, any suitable actuating mechanism may be used to operate ice dispenser 144. For example, ice dispenser 144 can include a sensor (such as an ultrasonic sensor) or a button rather than the paddle. Discharging outlet 146 and actuating mechanism 148 are an external part of ice dispenser 144 and are mounted in dispenser recess 142.

Referring again to FIG. 2, inside refrigerator appliance 100, freezer door 130 may include an ice dispensing system 150 that generally includes one or more icemakers and ice storage bins 152 that are configured to form ice. In this regard, for example, ice dispensing system 150 may define an ice making chamber 154 for housing ice making assemblies, storage mechanisms, and dispensing mechanisms. According to the illustrated embodiment, ice dispensing system 150 may include dispensing assembly 140 and may have a main icemaker 156. In addition, ice dispensing system 150 may include an icemaker for forming "craft ice" that is commonly large, clear cubes or spheres of ice for alcoholic or non-alcoholic drinks. For example, a user may access this craft ice by opening freezer door 130 and accessing storage bin 152 directly.

A control panel 160 is provided for controlling the mode of operation. For example, control panel 160 includes one or more selector inputs 162, such as knobs, buttons, touch-screen interfaces, etc., such as a water dispensing button and an ice-dispensing button, for selecting a desired mode of operation such as crushed or non-crushed ice. In addition, inputs 162 may be used to specify a fill volume or method of operating dispensing assembly 140. In this regard, inputs 162 may be in communication with a processing device or controller 164. Signals generated in controller 164 operate refrigerator appliance 100 and dispensing assembly 140 in response to selector inputs 162. Additionally, a display 166, such as an indicator light or a screen, may be provided on control panel 160. Display 166 may be in communication with controller 164 and may display information in response to signals from controller 164.

As used herein, "processing device" or "controller" may refer to one or more microprocessors or semiconductor devices and is not restricted necessarily to a single element. The processing device can be programmed to operate refrigerator appliance 100 and dispensing assembly 140. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations.

Referring again briefly to FIG. 1, according to an exemplary embodiment, cabinet 102 also defines a mechanical compartment 170 at or near the bottom 106 of the cabinet 102 for receipt of a hermetically sealed cooling system 172. In general, sealed cooling system 172 is configured for transporting heat from the inside of refrigerator appliance 100 to the outside (e.g., by executing a vapor-compression cycle or another suitable refrigeration cycle). As is generally understood by those of skill in the art, the hermetically sealed system 172 contains a working fluid, e.g., refrigerant, which flows between various heat exchangers of the sealed system 172 where the working fluid changes phases while transferring thermal energy.

Figure 3:
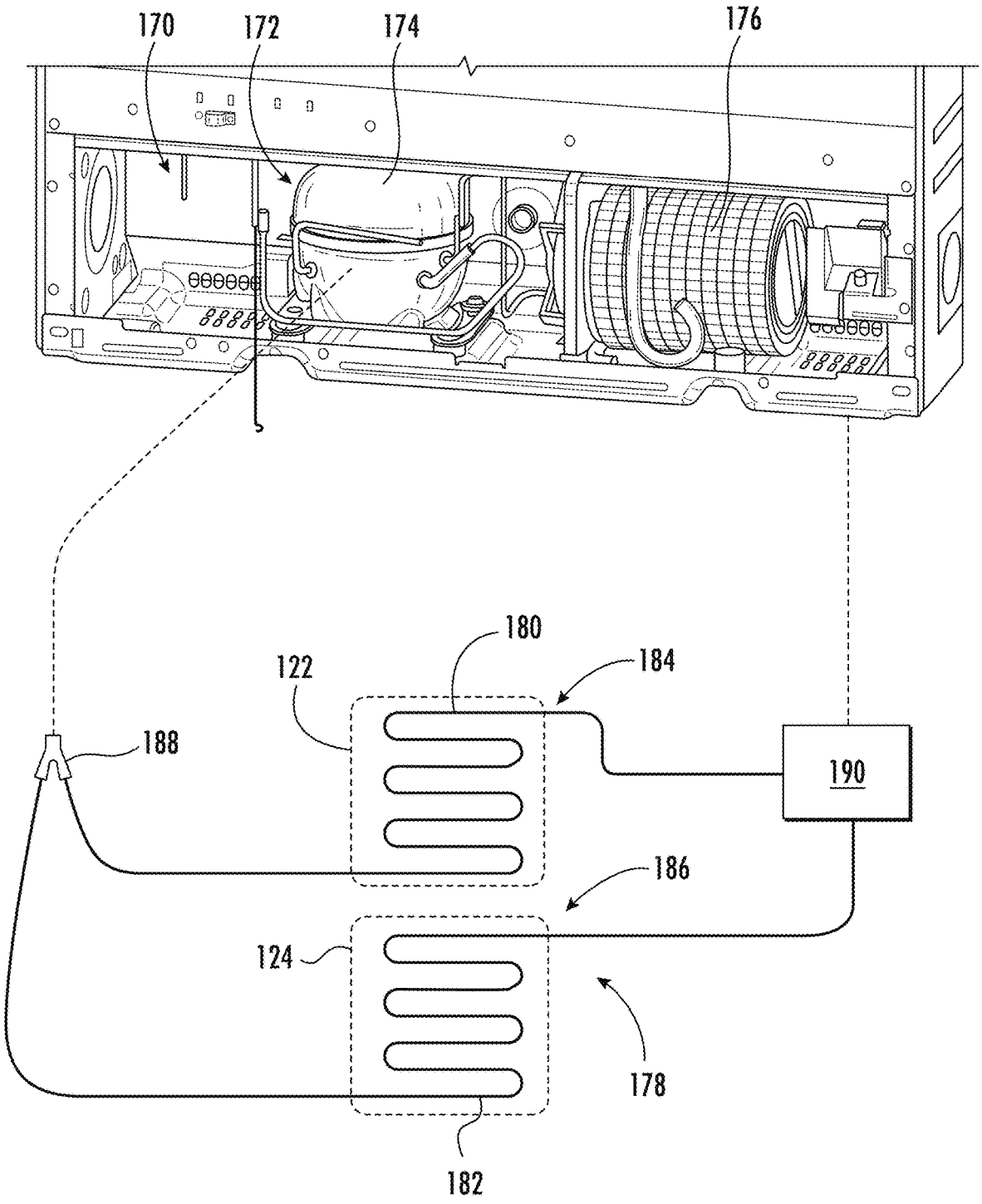
FIG. 3 provides a perspective view of a mechanical compartment and sealed system of the example refrigerator appliance of FIG. 1 according to an example embodiment of the present subject matter.

Specifically, referring now also to FIG. 3, sealed cooling system 172 may include a compressor 174 that is generally configured for compressing and circulating refrigerant within the sealed cooling system 172. Sealed cooling system 172 may include a single condenser 176 fluidly coupled to the compressor 174 for discharging heat to the ambient environment and cooling the refrigerant. In addition, sealed system 172 may generally include an evaporator 178 for cooling fresh food chamber 122 and freezer chamber 124, as described in more detail below. Specifically, as shown schematically in FIG. 3, evaporator 178 may generally include a first evaporator coil 180 and a second evaporator coil 182 that each have a separate inlet but which are joined before returning to the condenser 176.

According to an example embodiment, first evaporator coil 180 may be positioned within a first evaporator plenum and second evaporator coil 182 may be positioned within a second evaporator plenum. These plenums may be divided by a mullion and covered by an evaporator cover that defines one or more fluid passageways through which a flow of air may be circulated between the plenums and their respective chilled chambers. In addition, sealed cooling system 172 may include one or more fans for circulating a flow of air and to regulate the temperature within fresh food chamber 122 and freezer chamber 124.

Referring still to FIG. 3, evaporator 178 may include a dedicated inlet for each of first evaporator coil 180 and second evaporator coil 182 and a shared outlet. Specifically, first evaporator coil 180 defines a first evaporator inlet 184 and second evaporator coil 182 defines a second evaporator inlet 186. According to an example embodiment, capillary tubes or another suitable expansion device may be coupled to evaporator coils 180, 182, e.g., for controlling the expansion of refrigerant within sealed system 172. In addition, evaporator 178 may include a single shared outlet 188, such as a Y-shaped joint fitting, a tee joint, etc. According to example embodiments, the flows of refrigerant passing through first evaporator coil 180 and second evaporator coil 182 may be merged at shared outlet 188, e.g., such that a single flow of refrigerant passes exits evaporator 178 and enters compressor 174. It should be appreciated that any other suitable manner of merging the streams of refrigerant is possible and within the scope of the present subject matter. Although evaporator 178 is illustrated as having two coils for independently regulating temperature within two chambers, it should be appreciated that evaporator may include additional coils for cooling additional chambers.

According to the illustrated embodiment, compressor 174 may compress the refrigerant and pass it into condenser 176 of sealed system 172. Sealed system 172 may further include a refrigerant control valve, e.g., a three-way valve 190 positioned downstream of condenser 176 for selectively expanding and directing the flow of refrigerant to one or both of the first evaporator coil 180 or the second evaporator coil 182. For example, three-way valve 190 may be designed to divide, direct, or otherwise regulate the flow of refrigerant as needed based on the cooling needs of each respective chamber. In addition, according to an example, embodiment, three-way valve 190 may be configured to selectively expand the refrigerant as needed to facilitate the heat exchange process.

Now that the construction of refrigerator appliance 100 and sealed system 172 have been described according to example embodiments of the present subject matter, an exemplary method 200 of operating a refrigerator appliance 100 will be described. Although the discussion below refers to the exemplary method 200 of operating compressor 174 of refrigerator appliance 100, one skilled in the art will appreciate that the exemplary method 200 is applicable to the operation of a variety of other compressor types and sealed system configurations.

In exemplary embodiments, the various method steps as disclosed herein may be performed by controller 164 or a separate, dedicated controller. In this regard, as described herein, controller 164 of refrigerator appliance 100 may implement all steps of method 200. However, it should be appreciated that according to alternative embodiments, controller 164 may offload the performance of steps described herein, e.g., by communicating with a network or a remote server. Other distributed computing arrangements are possible and within the scope of the present subject matter.

Figure 4:
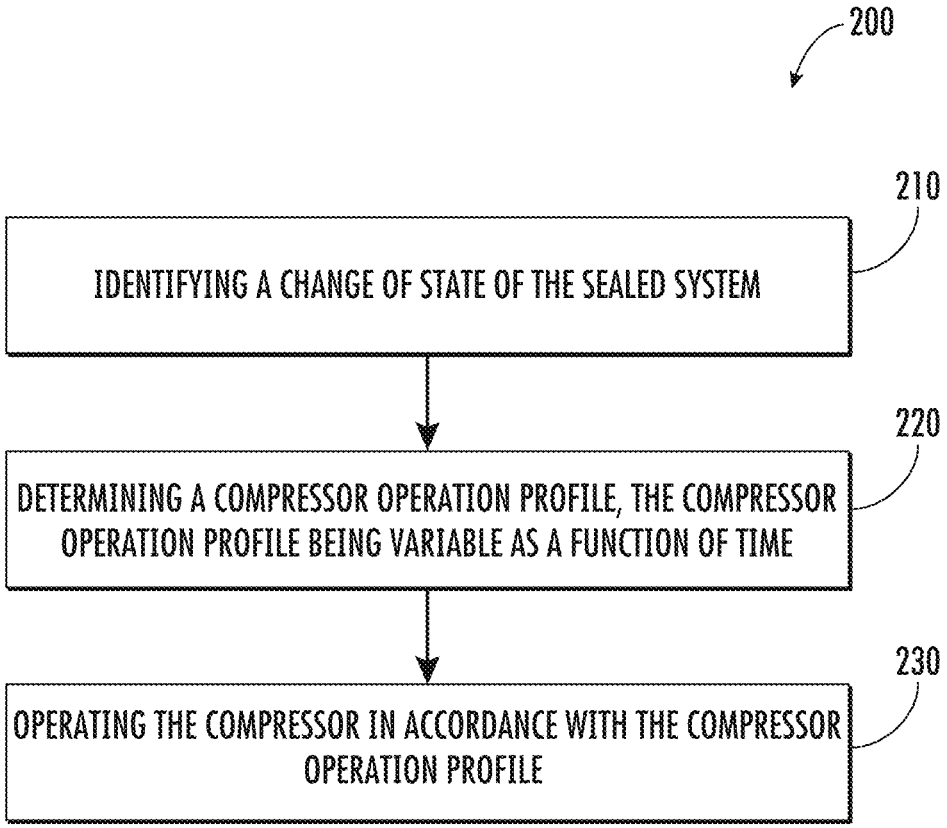
FIG. 4 illustrates a method for operating a compressor in accordance with one embodiment of the present subject matter.
Figure 5:
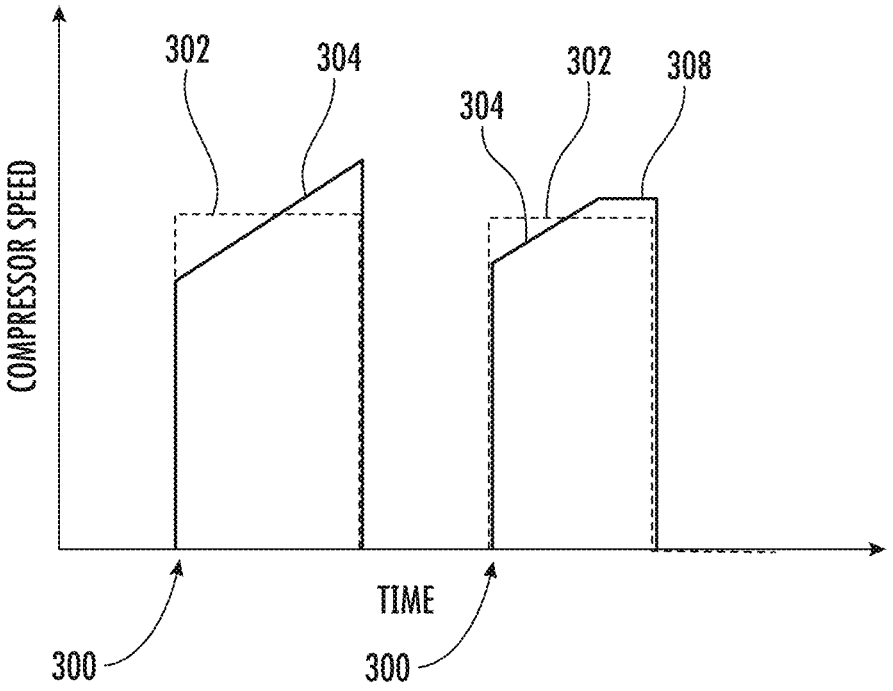
FIG. 5 is a plot of compressor speed while operating in accordance with methods of the present subject matter.

Referring now to FIG. 4, method 200 includes, at step 210, identifying a change of state of the sealed system. In this regard, for example, the change of state of sealed system 172 may generally refer to situations or events when sealed system 172 is in transitioning between operating modes, there are changes in compressor operation, or other events where compressor 174 may be operating with transient, lower efficiency performance. For example, the change in state of the sealed system may be a change in valve position of the refrigerant control valve (e.g., a change in the operation of three-way valve 190). In this regard, three-way valve 190 may be adjusted to direct some or all refrigerant through first evaporator coil 180 or second evaporator coil 182, and this may constitute a change of state of sealed system 172. According to another example embodiment, the change in state of sealed system 172 may be the start-up or energization of compressor 174. The change of state of sealed system 172 is illustrated in FIG. 5 generally by reference numeral 300.

Step 220 may generally include determining a compressor operation profile in response to detecting the change of state of sealed system 172. For example, the compressor operation profile may be variable as a function of time. By contrast, conventional compressor operation in refrigerator appliance is an ON/OFF state, where the compressor speed is maintained at a fixed speed for the duration of sealed system operation. This conventional speed profile is identified in FIG. 5 by reference numeral 302. However, this fixed speed profile 302 results in compressor inefficiency and sealed system inefficiencies. Accordingly, step 220 includes determining the compressor operation profile that varies as a function of time and results in improved efficiency of sealed system 172.

The compressor operation profile may be preprogrammed into controller 164 based on the triggering condition, e.g., what change of state has occurred, and may vary based on numerous factors. For example, the compressor operation profile may vary based on whether refrigerant is directed toward the fresh food evaporator (e.g., first evaporator coil 180) or the freezer evaporator (e.g., second evaporator coil 182). According to an example embodiment, the compressor operation profile may include a linear ramp profile (e.g., as shown by reference numeral 304 in FIG. 5). By contrast, the compressor operation profile may include a linear ramp profile with upper or lower speed limits (e.g., as shown by reference numeral 306 in FIG. 5). For example, an upper operating speed limit 308 is illustrated, but a lower operating speed limit may also be included.

According to alternative embodiments, compressor operation profile may include a plurality of linear segments, may be an exponential or polynomial function of time, may take the form of a step-function, etc. The compressor operation profile may also be independent of a target temperature of sealed system 172, may be based on ambient temperatures, etc. Step 230 may include operating compressor 174 in accordance with the compressor operation profile, resulting in improved system efficiency.

FIG. 4 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 are explained using refrigerator appliance 100 and sealed system 172 as an example, it should be appreciated that this method may be applied to the operation of any sealed system or compressor.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A refrigerator appliance defining a vertical direction, a lateral direction, and a transverse direction, comprising:
- a cabinet defining one or more chilled chambers;
- a sealed system comprising a compressor and one or more evaporators thermally coupled to the one or more chilled chambers; and
- a controller operably coupled to the compressor, the controller being configured to:
  - identify a change of state of the sealed system;
  - determine a compressor operation profile, the compressor operation profile being variable as a function of time, wherein the compressor operation profile is independent of a target temperature of the sealed system; and
  - operate the compressor in accordance with the compressor operation profile.

2. The refrigerator appliance of claim 1, wherein the sealed system further comprises a refrigerant control valve for regulating a flow of refrigerant, and wherein the change in state of the sealed system is a change in valve position of the refrigerant control valve.

3. The refrigerator appliance of claim 2, wherein the one or more evaporators comprises a fresh food evaporator and a freezer evaporator.

4. The refrigerator appliance of claim 3, wherein the compressor operation profile varies based on whether refrigerant is directed toward the fresh food evaporator or the freezer evaporator.

5. The refrigerator appliance of claim 2, wherein the refrigerant control valve is a three-way valve.

6. The refrigerator appliance of claim 1, wherein the change in state of the sealed system is the start-up of the compressor.

7. The refrigerator appliance of claim 1, wherein the compressor operation profile comprises a linear ramp profile.

8. The refrigerator appliance of claim 1, wherein the compressor operation profile comprises at least one of an upper operating speed limit or a lower operating speed limit.

9. The refrigerator appliance of claim 1, wherein the compressor operation profile comprises a plurality of linear segments.

10. The refrigerator appliance of claim 1, wherein the compressor operation profile is an exponential or polynomial function of time.

11. A method of operating a compressor of a refrigerator appliance, the refrigerator appliance comprising one or more chilled chambers and a sealed system comprising a compressor and one or more evaporators thermally coupled to the one or more chilled chambers, the method comprising:

identifying a change of state of the sealed system;

determining a compressor operation profile, the compressor operation profile being variable as a function of time, wherein the compressor operation profile is independent of a target temperature of the sealed system; and operating the compressor in accordance with the compressor operation profile.

12. The method of claim 11, wherein the sealed system further comprises a refrigerant control valve for regulating a flow of refrigerant, and wherein the change in state of the sealed system is a change in valve position of the refrigerant control valve.

13. The method of claim 12, wherein the one or more evaporators comprises a fresh food evaporator and a freezer evaporator, wherein the compressor operation profile varies based on whether refrigerant is directed toward the fresh food evaporator or the freezer evaporator.

14. The method of claim 12, wherein the refrigerant control valve is a three-way valve.

15. The method of claim 11, wherein the change in state of the sealed system is the start-up of the compressor.

16. The method of claim 11, wherein the compressor operation profile comprises a linear ramp profile.

17. The method of claim 11, wherein the compressor operation profile comprises at least one of an upper operating speed limit or a lower operating speed limit.

18. The method of claim 11, wherein the compressor operation profile comprises a plurality of linear segments.

* * * * *